US009376798B1

(12) United States Patent
Bong

(10) Patent No.: US 9,376,798 B1
(45) Date of Patent: Jun. 28, 2016

(54) W-COLUMN FOR ON-SITE ERECTION OF STEEL FRAMED HIGH RISE BUILDINGS, AND METHODS OF USE

(71) Applicant: William L. Bong, Walnut Creek, CA (US)

(72) Inventor: William L. Bong, Walnut Creek, CA (US)

( * ) Notice: Subject to any disclaimer, the term of this patent is extended or adjusted under 35 U.S.C. 154(b) by 0 days.

(21) Appl. No.: 14/965,478

(22) Filed: Dec. 10, 2015

Related U.S. Application Data

(60) Provisional application No. 62/093,011, filed on Dec. 17, 2014.

(51) Int. Cl.
*E04B 1/24* (2006.01)
*E04C 3/32* (2006.01)

(52) U.S. Cl.
CPC ..... *E04B 1/2403* (2013.01); *E04C 3/32* (2013.01); *E04B 2001/246* (2013.01); *E04B 2001/2415* (2013.01); *E04B 2001/2418* (2013.01); *E04B 2001/2427* (2013.01); *E04B 2001/2451* (2013.01)

(58) Field of Classification Search
CPC ..... E04B 2001/2415; E04B 2001/2448; E04B 1/2403; E04B 2001/2445; E04B 1/24; E04B 2001/2457; E04B 2001/2463; E04B 2001/2496; E04C 2003/0452; Y10T 403/57
See application file for complete search history.

(56) References Cited

U.S. PATENT DOCUMENTS 3,628,300 A * 12/1971 Tsurumi ..... E04B 1/2403 29/897.35
5,412,913 A * 5/1995 Daniels ..... E04B 1/24 212/177
5,660,017 A * 8/1997 Houghton ..... E04B 1/2403 52/167.3
6,138,427 A * 10/2000 Houghton ..... E04B 1/2403 52/236.3
6,561,736 B1 * 5/2003 Doleshal ..... E02D 37/00 405/211
6,591,573 B2 * 7/2003 Houghton ..... E04B 1/2403 52/236.3
7,047,695 B2 * 5/2006 Allen ..... E04B 1/2403 52/120
8,161,707 B2 * 4/2012 Simmons ..... E04B 1/24 403/170
8,910,336 B2 * 12/2014 Han ..... E01D 2/02 14/74.5
8,915,042 B2 * 12/2014 Ahn ..... E04B 1/24 52/236.6
2002/0005397 A1 * 1/2002 Bong ..... B23K 9/0203 219/125.1
2006/0144006 A1 * 7/2006 Suzuki ..... E04B 1/2403 52/655.1
2010/0176107 A1 * 7/2010 Bong ..... B23K 25/00 219/137 R

* cited by examiner

*Primary Examiner* — Brian Glessner
*Assistant Examiner* — Omar Hijaz
(74) *Attorney, Agent, or Firm* — Charles L. Thoeming

(57) ABSTRACT

An improved W-column provides flange tabs on the top-and-bottom outside corners of the W-column flanges, and vertical bolt-on connections to temporarily mount one column positioned by a crane on top of another by bolting the bolt-on connections to the corresponding flange tabs to properly align one W-column above another W-column. The improved W-column further allows the two vertically positioned W-columns also to be connected together by bolting the web of the upper W-column to the web of the lower W-column before permanently welding the two vertical W-columns together. Once positioned, these vertically aligned W-columns are can be permanently joined together with the Arcmatic® VertaSlag® ESW-NG welding process. In this manner all vertical W-column elements of a steel framed high rise building can be quickly erected.

22 Claims, 15 Drawing Sheets

W-COLUMN FOR ON-SITE ERECTION OF STEEL FRAMED HIGH RISE BUILDINGS, AND METHODS OF USE

CROSS-REFERENCES TO RELATED APPLICATIONS

This United States non-provisional patent application is based upon and claims the filing date of U.S. provisional patent application Ser. No. 62/093,011 filed Dec. 17, 2014.

STATEMENT REGARDING FEDERALLY SPONSORED RESEARCH OR DEVELOPMENT

None.

REFERENCE TO A MICRO-FICHE APPENDIX

None.

TECHNICAL FIELD

This invention relates to erection of buildings. More particularly, the invention is related to improved, shop-fabricated steel columns or steel beams of H-shape such as American Institute of Steel Construction's (AISC's) wide flange (W), miscellaneous wide flange (M), standard (S), and HP rolled shapes; and H-shaped built-up plate girders, all of which are herein referred to as W-columns when referring to vertical girders and H-beams when referring to horizontal girders, and methods of use of the new W-column that can be used for rapid on-site erection of steel framed buildings.

BACKGROUND OF THE INVENTION

When erecting a high rise building, with existing W-column designs, the W-columns are joined together (one on top of the other), using an erection process that requires the columns be joined together using a very slow multi-pass manual welding process. To improve the speed, quality, and economics of erecting steel framed buildings methods must be found to: (1) make full penetration welds attaching "base plates" to the bottom of the column flanges, whereby the base plate can, in turn, be bolted to piers or foundations; (2) weld the flanges of two W-columns together lengthwise (one on top of the other), using the Arcmatic® single-pass VertaSlag® welding process for a Welding Society Narrow Gap Electroslag Welding Method (ESW-NG)—welding both column flanges at the same time, using the fully automated programmable, computer controlled Arcmatic® VertSlag® welding process to replace the older manual multi-pass arc welding processes to speed up column splicing; (3) use four welded-on flange tabs, welded to the flanges of the two vertical W-columns that are being joined together, and vertical bars bolted together to temporarily hold the upper W-column flanges to the lower W-column flanges until the final single-pass Arcmatic® VertaSlag® welds can be used to permanently join the upper and lower W-column flanges together to speedup building erection process; and (4) to weld horizontal H-beams to W-column at each floor level moment area.

The number of columns welded (spliced) together, the available column length, and the number of moment connections on each column length depend on the number of columns in a structure's grid, the height of the structure, code and site requirements for the structure, engineering considerations for the structure, and transport limitations. Consider, for example, the erection of a building structure with a 20-foot available column length. Column splices must exist at every other story of the building. Assume the building is 8 columns wide by 8 rows deep forming a grid consisting of 8×8=64 columns, and the building is 40 stories. This building would require 40/2=20×64=1280 column splices. If each column splice averaged 30 man-hours (man-hours depends on the thickness of the column flanges) to weld using an existing multi-pass arc welding method, the total man-hours consumed would be expressed by the equation: (1280-splices)×(30 man-hours)=38,400 man-hours. If each man hour averaged approximately US-$75 per hour (depending on the thickness of the column flanges), the total cost to splice all of the columns is expressed by the equation: (US-$75×38,400 man-hours)=US$2,880,000.00.

If the existing cost of field splicing the W-column flanges together is US$2,880,000, the cost to erect a high rise steel frame building on site would be substantially reduced. In addition to the reduction in cost for splicing W-columns, the time required to erect the building would, in turn, be substantially reduced. For instance, there is a daily overhead cost to erect the building, if the frame can be erected faster by using the Arcmatic® W-column splicing method; the speed of all of the other construction details could also be increased, therefore decreasing the total construction time and expense.

There has never been a steel frame high rise building constructed using American Welding Society Narrow Gap Electroslag Welding Process (ESW-NG). There is no W-column in the art that provides the features and improvements amenable to constructing a steel frame high rise building using ESW-NG processes on site.

Thus, there is a need for an improved W-column design to erect a high rise steel frame building on site so where W-columns could be quickly aligned vertically allowing the temporary bolted connection to hold the vertically aligned W-columns together until the vertically aligned W-columns have been properly aligned, and welded with vertical Narrow Gap ElectroSlag or ElectroGas welding applications to permanently weld the W-column-to-W-column connections for corresponding vertically aligned W-columns.

There is a corresponding need for an improved W-column design to erect a high rise steel frame building on site where the W-column can carry increased stresses at a minimum cost.

There is yet another need for an improved W-column design to erect a high rise steel frame building on site that allows the Arcmatic® VertaSlag® ESW-NG welding process that uses a square-groove vertical welding connection that is in compliance with each applicable section and subsection of the AWS D1.1:2004 and AWS D1.8-05 Structural Welding Codes.

DISCLOSURE OF INVENTION

The improved W-column design can be shop-fabricated using the Arcmatic® patented VertaSlag® ESW-NG welding process. The Arcmatic® VertaSlag® ESW-NG welding process uses a number of methods, also patented and/or patent pending products and processes developed by Arcmatic®. These VertaSlag® welding processes include an Arcmatic® patented computer controlled welding system, an Arcmatic® patented modular component welding system, an Arcmatic® Consumable Guide tube specifically designed for Narrow Gap ElectroSlag welding, and an Arcmatic® patent pending water-cooled copper tri-part flexible copper welding shoe. The Arcmatic® VertaSlag® welding process is a highly developed, computer controlled, programmable version of the American Welding Society's ("AWS") newly developed version of the older ElectroSlag (ESW) welding process. This newer process is now referred to as the "American Welding Society Narrow Gap ElectroSlag Welding Process (ESW-NG)". The newly designed W-column is designed to provide welded-on flange tabs that can be temporarily welded onto the top-and-bottom outside corners of the W-column flanges, and vertical bolt-on connections can be used to temporarily mount one column positioned by a crane on top of another by bolting the bolt-on connections to the matching welded-on flange tabs that have been welded to the corners of the vertical column flanges. In this manner, the vertical W-columns can be properly aligned before permanently VertaSlag® ESW-NG welding the two vertical W-columns together.

The Arcmatic® new and improved W-column design further allows two vertically positioned W-columns to be connected together by bolting the web of the upper W-column to the web of the lower W-column, so the two W-columns can be quickly (but temporarily) joined together. Later, these vertically aligned W-columns (after the crane used to position the top W-column above the bottom W-column is released) can be permanently joined together with the Arcmatic® VertaSlag® ESW-NG welding process (one on top of the other). In this manner all vertical W-column elements of a high rise building can be quickly erected.

BRIEF DESCRIPTION OF DRAWINGS

These and other features, aspects, and advantages of the present invention will become better understood with regard to the following description, appended claims, and accompanying drawings as further described.

" and FIG. 4 is also the detail front elevation view of the improved W-column 10 of FIG. 3.

" and FIG. 6 is also the detail front elevation view of the embodiment of improved W-column 10 of FIG. 5.

BEST MODE FOR CARRYING OUT THE INVENTION

Figure 1:
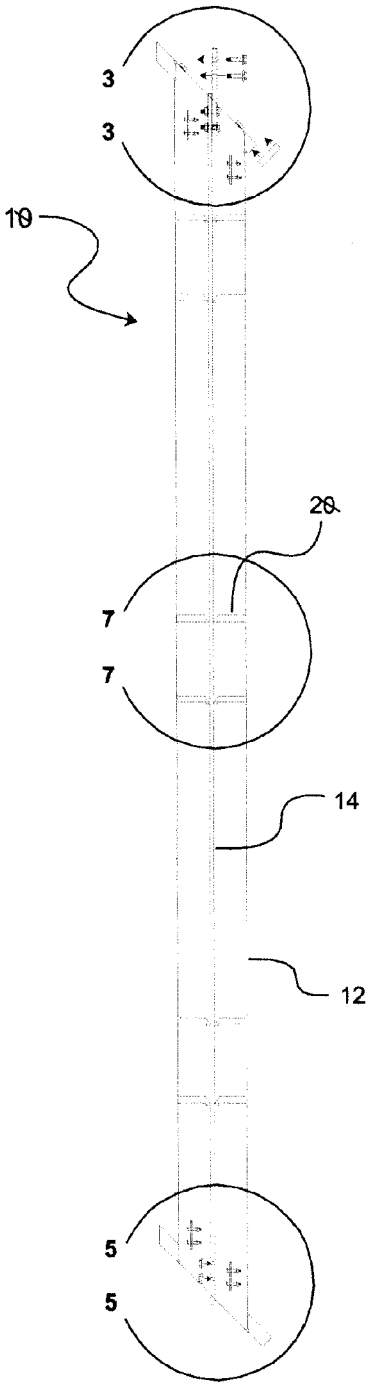
FIG. 1 is a side elevation view of an embodiment of improved W-column 10 for erection of high rise buildings.

Referring more specifically to the drawings, for illustrative purposes the improved W-column 10 design and methods of use thereof are embodied generally in FIGS. 1-21, and provide embodiments of the improved W-column 10 design and methods of use thereof as disclosed and discussed in this patent application. These illustrations show the design changes of a vertically positioned W-column that will allow the column to be field erected with the single-pass Arcmatic® VertaSlag® ESW-NG welding process.

It will be appreciated that the designs, systems and/or methods may vary as to configuration and as to the details of the parts, and that the methods of using the systems may vary as to details and to the order of steps, without departing from the basic concepts as disclosed herein. It will be likewise appreciated; the Arcmatic® VertaSlag® ESW-NG welding process is a Narrow Gap ElectroSlag welding application. The improved W-column 10 design is disclosed generally in terms of is use in erecting steel framed high-rise buildings on site principally using only narrow gap ElectroSlag or ElectroGas welding applications. However, the disclosed improved W-column 10 design may be used in a large variety of steel structure erection applications, as will be readily apparent to those skilled in the art. Finally, it will be appreciated that a narrow gap ElectroSlag welding application can be also performed by narrow gap ElectroGas welding application.

As depicted in FIGS. 13-21, embodiments of a vertically positioned improved W-column 10 can receive a horizontally positioned H-beam to be site welded to the W-column flanges 12 allowing the moment load to be carried from the H-beam, through the W-column flange 12, to the moment plates (stiffeners) welded between the W-column flanges 12 at each moment connection. The improved W-column 10 will be shop-fabricated, so each moment area will have shop-welded moment plates 20 welded between the W-column flanges 12. Even though one W-column 10 can be quickly connected (one on top of the other) using the Arcmatic® VertaSlag® ESW-NG welding process to speed up erection of the building, many building design firms still wish to use the older multi-pass FCAW welding process to weld the horizontal beam flanges to the vertical W-column flanges 14 to pass the moment load through moment plates welded between the W-column flanges 14 at each moment area to pass the moment load through the improved W-column 10 moment area.

Since the Arcmatic® new and improved W-column design 10 allows two vertically positioned W-columns to be connected together by bolting the web of the upper W-column to the web of the lower W-column, the cut lengths of the W-column may vary between erection sites as dictated by code and site requirements, engineering considerations, and the size of the building to be erected. For example, an embodiment of the improved W-column 10 design provides an approximately thirty (30') foot W-column 10 having 45 degree spliced ends providing the spliced W-column flange 14 ends that are parallel. A single bolt-on connection plate 40 welded to one side of the top of the W-column web 14 to support upper and lower W-column webs 14, FIGS. 1-10, 13 and 15. For the on-site erection and VertaSlag® ESW-NG welding of improved W-columns, the bolt-on web connection plates 40 is first attaching the upper end of a lower vertically positioned W-column web 14. During the building erection process, when the upper W-column web 14 is lowered onto the lower W-column web 14, the connection plate 40 is then bolted to a lower end of the upper vertically positioned W-column web 14 to temporarily hold the upper and lower W-column webs 14 together. The upper W-column flanges 12 sit on top of spacer blocks 60 that have been tack welded to the top of the lower column flange W-column flanges 12 to provide a secure mounting surface for the lower surfaces of the upper W-column flanges 12, and to create a VertaSlag® ESW-NG weld groove 72. The four bolt-on connections 32 are then bolted to the matching upper and lower welded-on flange tabs 30 to temporarily hold the upper and lower W-column 10 together. After the bolt-on connections 32 have been securely bolted to the upper and lower matching welded-on flange tabs 30, the spacer blocks are removed, allowing the VertaSlag® ESW-NG welds 72 to be completed to permanently attach the two W-columns 10 together in vertical alignment, one below the other, FIG. 19.

Figure 21:
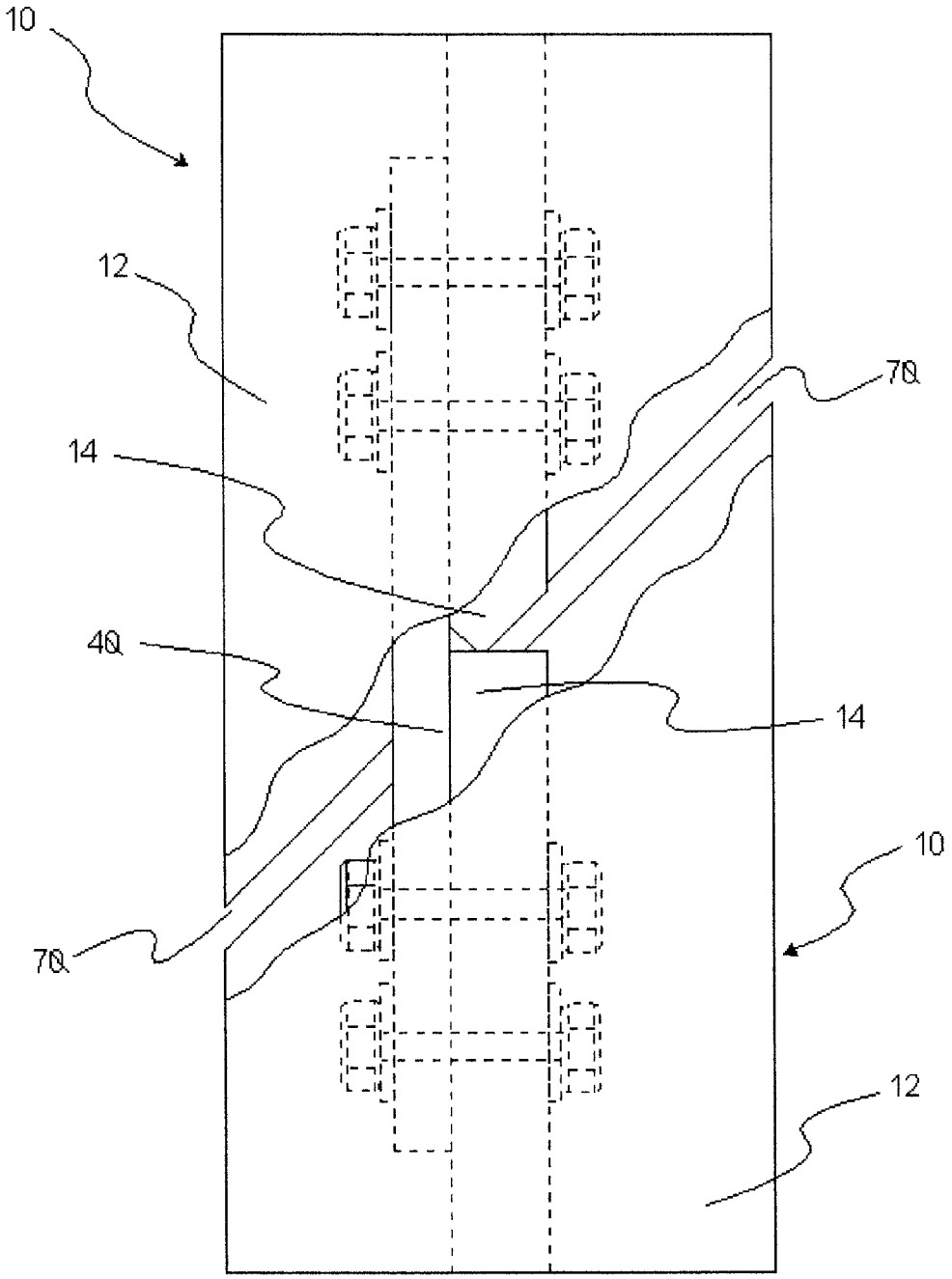
FIG. 21 is a partial elevation view of the embodiment of improved W-column 10 of FIG. 11 with portions of the W-column 10 flanges 12 cut away to depict the bottom of the top web 14 plate "double-beveled" with one-third of the web plate 14 thickness beveled with a forty-five (45°) degree angle on the connection plate 40 side, and two-thirds of the web plate 14 thickness beveled with a forty-five (45°) degree angle on the side opposite the connection plate 40, and the two web plates 14 are joined together (one on top of the other) with a bolt-on connection plate 40.

When welding larger W-columns 10, the web plates are much thicker, FIG. 21. The bottom of the top web 14 plate is "double-beveled" with one-third of the web plate 14 thickness beveled with a forty-five (45°) degree angle on the connection plate 40 side, and two-thirds of the web plate 14 thickness beveled with a forty-five (45°) degree angle on the side opposite the connection plate 40. The two-thirds beveled web plate 40 side is then first welded with multi-pass Flux Cored Welding Wire (FCAW). The connection plate 40 is then removed, and the one-third beveled web plate 40 side is back-gouged and welded. After the two welds have been completed, the connection plate is no longer needed and is discarded. The two corresponding flange plate 12 surfaces of the top and bottom W-columns are then welded together with the forty-five (45°) degree VertaSlag welding process.

Figure 20:
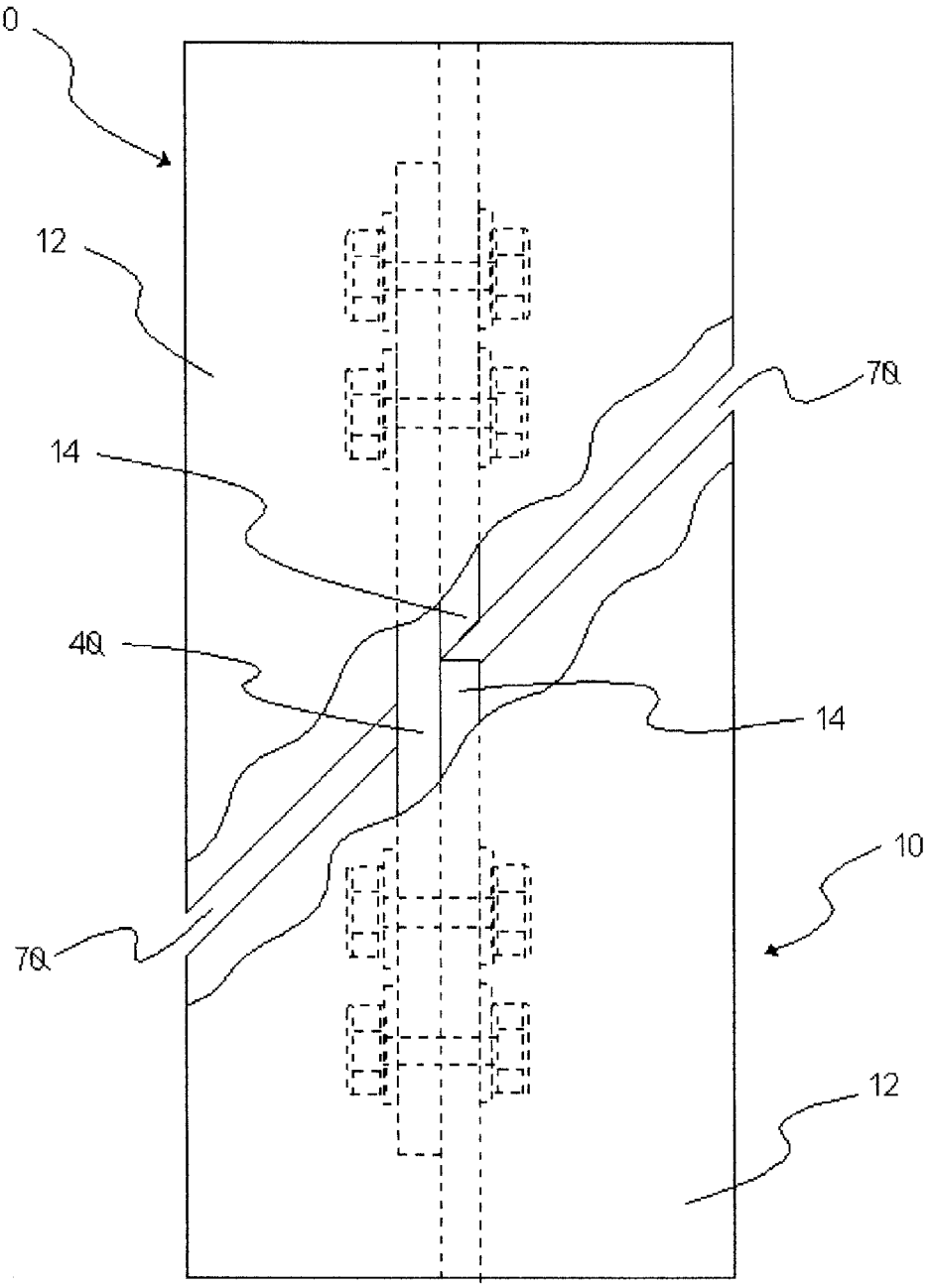
FIG. 20 is a partial side elevation view of the embodiment of improved W-columns 10 of FIG. 11 with portions of the W-column 10 flanges 12 cut away to depict the bottom of the top web plate 14 "single-beveled" with a forty-five (45°) degree angle and the two web plates 14 are joined together (one on top of the other) with a bolt-on connection plate 40.

When welding smaller W-columns 10, the web plates are much thinner, FIG. 20. The bottom of the top web plate 14 is "single-beveled" with a forty-five (45°) degree angle and the two web plates 14 are joined together (one on top of the other) with a bolt-on connection plate 40. The two web plates 14 are then welded together with the multi-pass FCAW welding process. After the weld has been completed, the connection plate 40 remains attached, helping connect the two web plates 14 together. After the two web plates 14 have been joined together, the VertaSlag welding process is used to join the two corresponding flange plate 12 surfaces of the top and bottom W-columns flange plates 12 together with a weld cavity 70 that is cut at a 45° from the horizontal plane.

The embodiment of improved W-column 10, providing an approximately thirty-foot W-column 10 includes three moment connection pairs of front and rear moment plates 20 welded between the W-column flanges 12 positioned along the W-column 10 such that the longitudinal length of the W-column web between each set of moment connection pairs of front moment plates 20 and rear moment plates 20 is at least twelve (12') feet. As with the cut lengths of the W-column 10 these distances between each set of moment connection pairs may vary between erection sites as dictated by code and site requirements, engineering considerations, and the size of the building to be erected.

Figure 2:
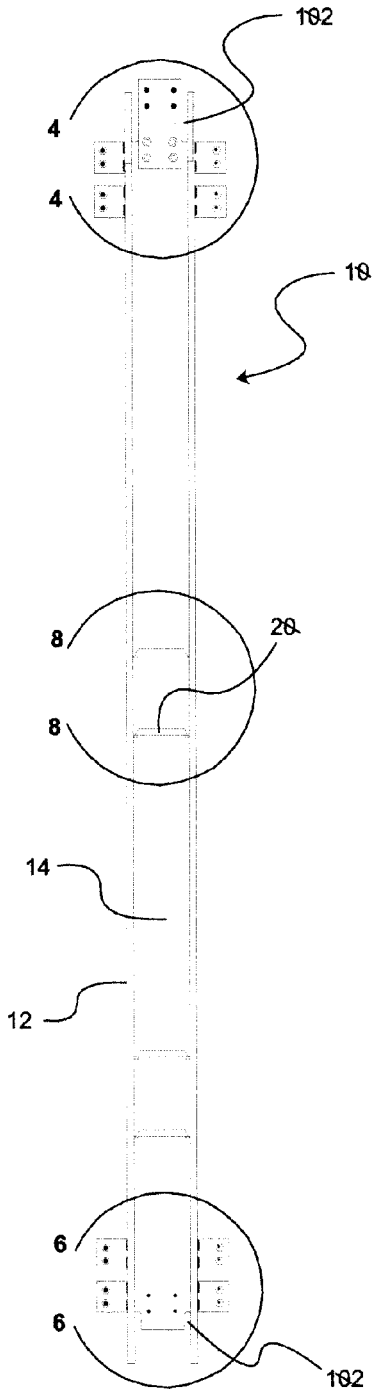
FIG. 2 is a front elevation view of the embodiment of improved W-column 10 of FIG. 1.

FIGS. 1 and 2 present an embodiment of the new Arcmatic® design for an improved W-column 10 that is useful and advantageous over existing methods and columns for fabricating and erecting a high rise building. This Arcmatic® W-column design uses the existing multi-pass, gasless flux-cored (FCAW) welding methods for shop-welding moment plates 20 (also known as "stiffeners") into the improved W-columns 10 prior to shipping the columns to the building erection side. The upper and lower ends of the W-column flanges 12 are then shop cut at a forty-five (45°) degree angle to the vertical plate, and relief grooves 102 are shop cut into either side of the upper and lower ends of the W-column webs 14 to make space for the Arcmatic articulated water-cooled copper shoes 74 used to make the VertaSlag (ESW-NG) welds, see, e.g., FIG. 18. When the W-columns 10 are at the erection site, one W-column 10 is placed on top of another W-column 10. With this new W-column 10 design, the top and bottom of the W-column 10 flanges 12 have been shop cut, at a forty-five (45°) degree angle to the vertical plane and the improved W-column 10 clearance slots have been shop cut into web 14, e.g. FIGS. 1-6, 13-19. This new W-column 10 flange 12 design permits W-columns 10 upper and lower flanges 12 to be welded together with the much faster and less expensive VertaSlag® programmable, computer controlled ESW-NG welding process. After positioning the W-columns 10 in place prior to welding, e.g. FIGS. 16-18, the time consuming and expensive preheating operation can be eliminated since the VertaSlag® ESW-NG welding process does not require preheating to prior to welding the two improved W-columns 10 together.

Figure 15:
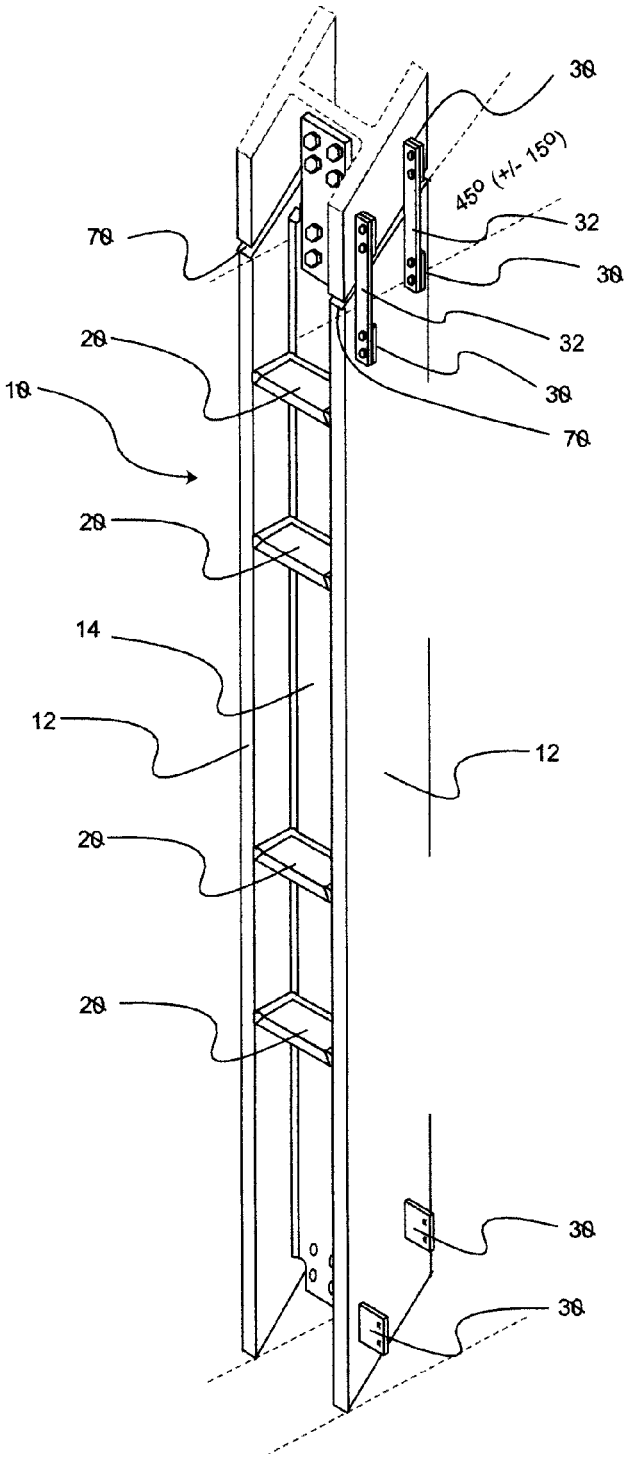
FIG. 15 is the partial perspective view of FIG. 14 with a partial perspective view of FIG. 11 of an embodiment of the improved W-column 10 shown in broken lines with the bolt-on connections and a bolt-on web connection plate joining embodiments of two separate but identical improved W-columns 10 in a vertical orientation, one embodiment of the improved W-column 10 above the other, and as also depicted in FIGS. 11 and 12.
Figure 17:
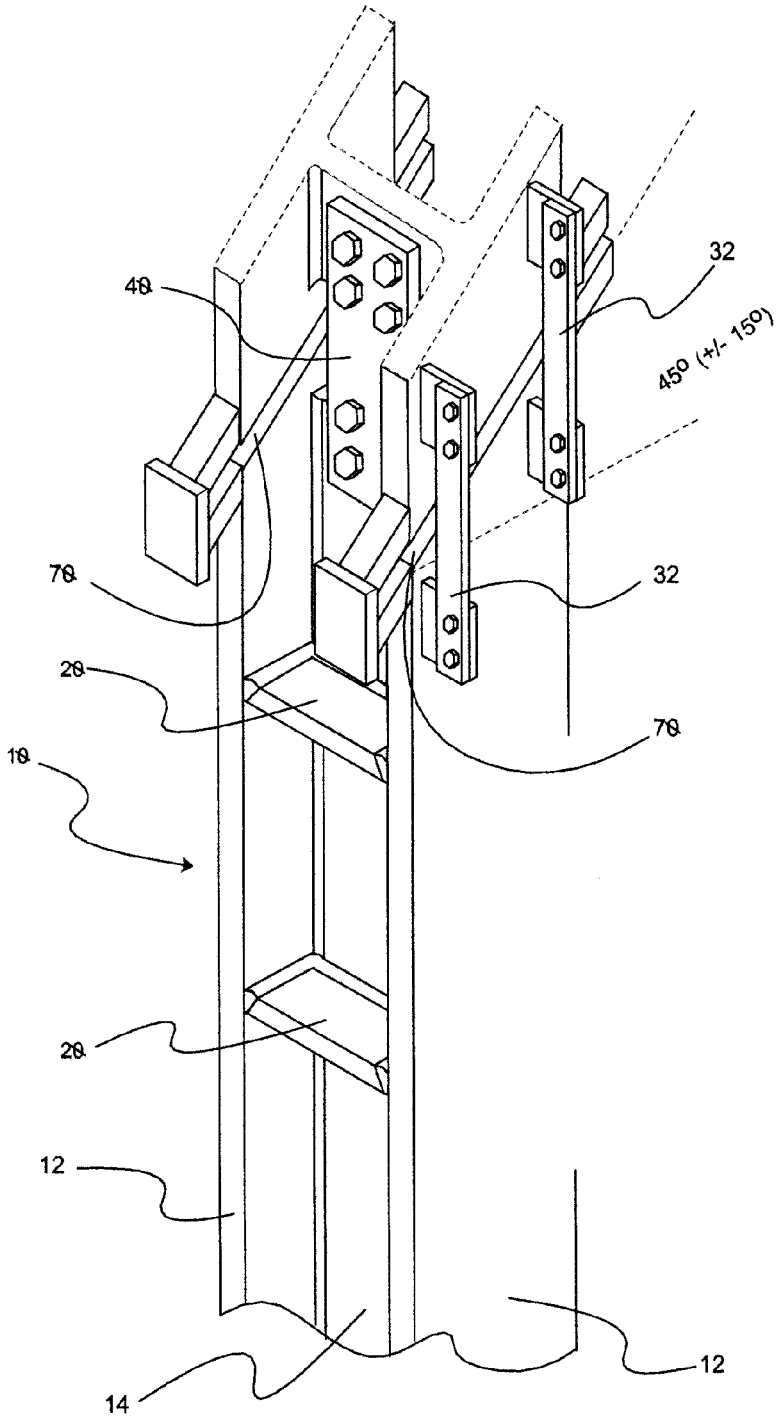
FIG. 17 is the partial perspective view of FIG. 16 with the partial perspective view of FIG. 5 for embodiments of the improved W-column 10 shown together with sumps 80 for each improved W-column weld cavity 70.
Figure 18:
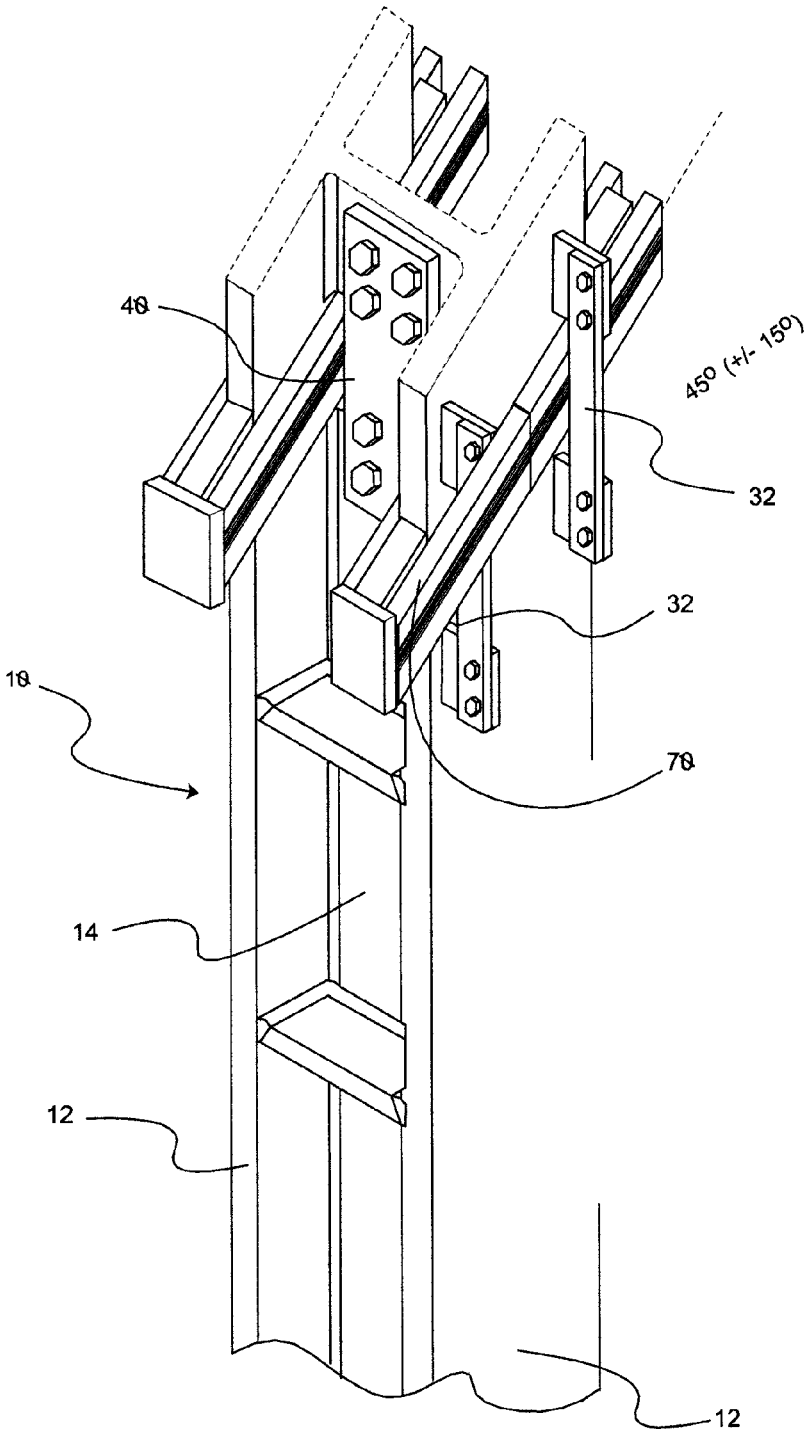
FIG. 18 is the partial perspective view of FIG. 17 depicting an embodiment of a welding shoe assembly for embodiments of each spliced improved W-column weld cavity in preparation for VertaSlag® (ESW-NG) welding process to join embodiment of the two vertically aligned improved W-columns 10 of FIG. 11.

After the upper embodiment of the improved W-column 10 web 14 has been set on top of the lower embodiment of the improved W-column 10 web 14, and the two webs have been bolted together, using the bolt-on connection plate 40 to temporarily connect the two columns together, and the outside bolt-on connections 32 have been bolted to the matching upper and lower welded-on flange tabs 32, that have been welded to the outside corners of embodiments of the upper and lower W-columns 10, FIG. 15, embodiments of welding shoes (e.g., such as the Arcmatic® articulated water cooled welding shoes) must be attached to the embodiment of the improved W-column 10 flanges 12 before the VertaSlag® (ESW-NG) welds can be made to permanently join the two columns together, FIGS. 17 and 18. Embodiments of welding shoes (e.g., such as the Arcmatic® articulated water cooled welding shoes) are used on either side of the ¾" weld gap 70 that is formed between the upper and lower W-column flanges 12 after the upper W-column web 14 is set on top of the lower W-column web 14 to create the weld gaps 70. When the Arcmatic articulated water-cooled copper-shoes 74 are inserted into the relief grooves 102 to secure the surfaces of the articulated copper shoes to the inside surfaces of the two flanges 12, above and below the weld gaps 70, and to secure the surfaces of the Arcmatic articulated water-cooled copper shoes between the bolt-on connections 32 and the outside surfaces of the two flanges 12, above and below the weld gaps 70, the VertaSlag® ESW-NG weld cavity has been formed. This weld cavity is then use to make the final VertaSlag® ESW-NG weld 72 that permanently joins the two W-column flanges 12 together, FIG. 19. The VertaSlag® ESW-NG welding operation can be completed in minutes, instead of hours. Thus, if the field erection welding operator needs to leave the computer controlled operation for a time, the operator can easily wait a few minutes until the particular engaged stage of the welding operation is conveniently completed—eliminating any and all preheating operations. And, since the VertaSlag® ESW-NG weld is completed in one single pass, there is no need for the time consuming and expensive inter-pass flux cleaning operation required by existing FCAW welding processes.

FIGS. 7-10 show details of the multi-pass FCAW weld joint in FIGS. 1 and 2. The same welding method for embodiments of the improved W-column 10 design uses the same welding methods for the moment plates 20 that are used for existing W-column designs. More advanced W-column disclosures providing novel and more advanced moment plate 20 designs and welding methods will be included in subsequent applications for these inventions.

Figure 3:
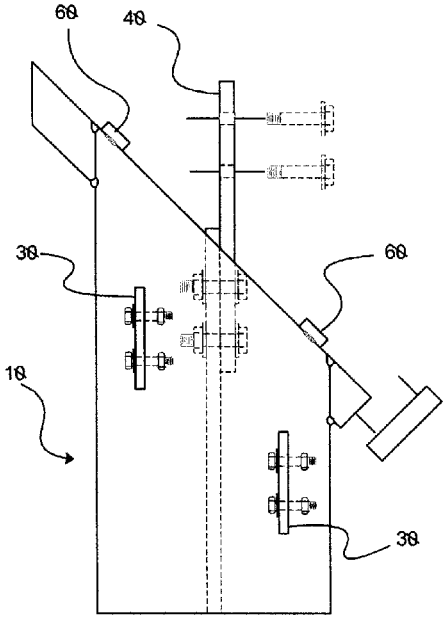
FIG. 3 is a detail side elevation view of the embodiment of improved W-column 10 of FIG. 1 taken at "3-3."
Figure 4:
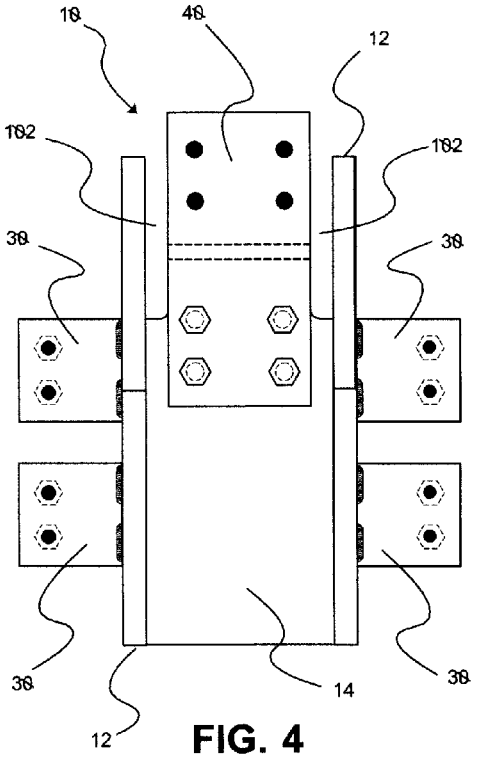
FIG. 4 is a detail front elevation view of the embodiment of improved W-column 10 of FIG. 2 taken at "4-4.
Figure 5:
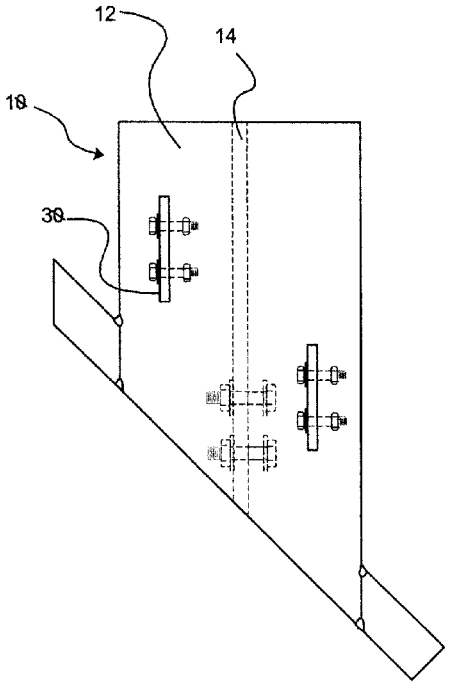
FIG. 5 is a detail side elevation view of the embodiment of improved W-column 10 of FIG. 1 taken at "5-5."
Figure 6:
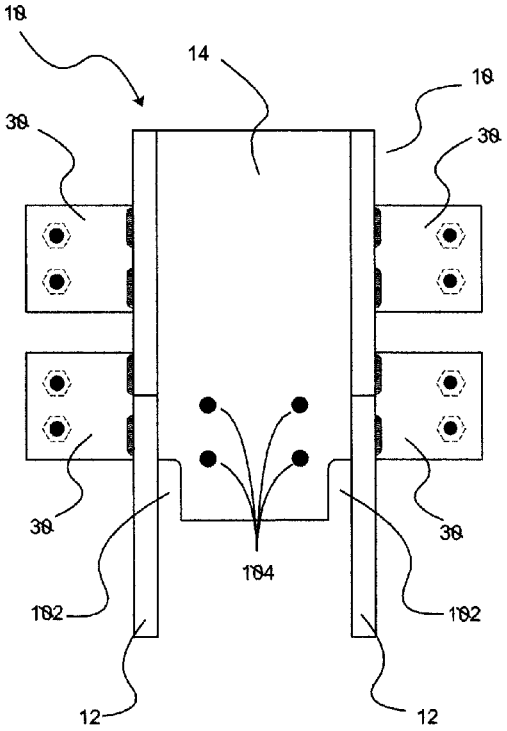
FIG. 6 is a detail front elevation view of the embodiment of improved W-column 10 of FIG. 2 taken at "6-6.
Figure 7:
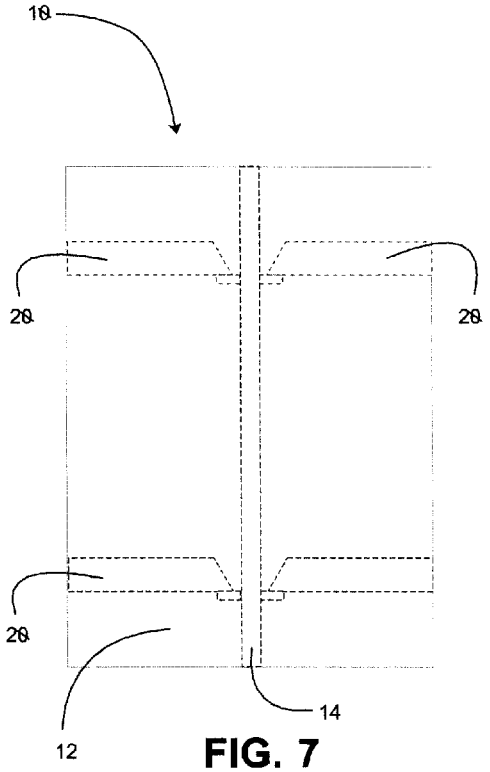
FIG. 7 is a detail side elevation view of the embodiment of improved W-column 10 of FIG. 1 taken at "7-7."
Figure 8:
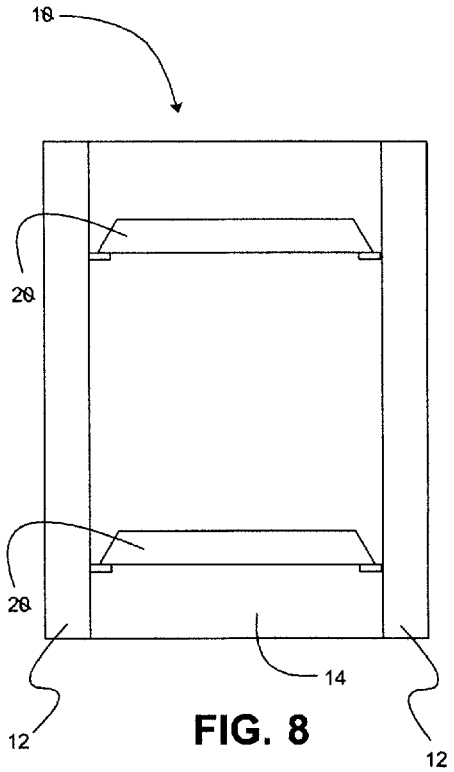
FIG. 8 is a detail front elevation view of the embodiment of improved W-column 10 of FIG. 2 taken at "8-8" [also the detail front elevation view of the embodiment of improved W-column 10 of FIG. 7].
Figure 9:
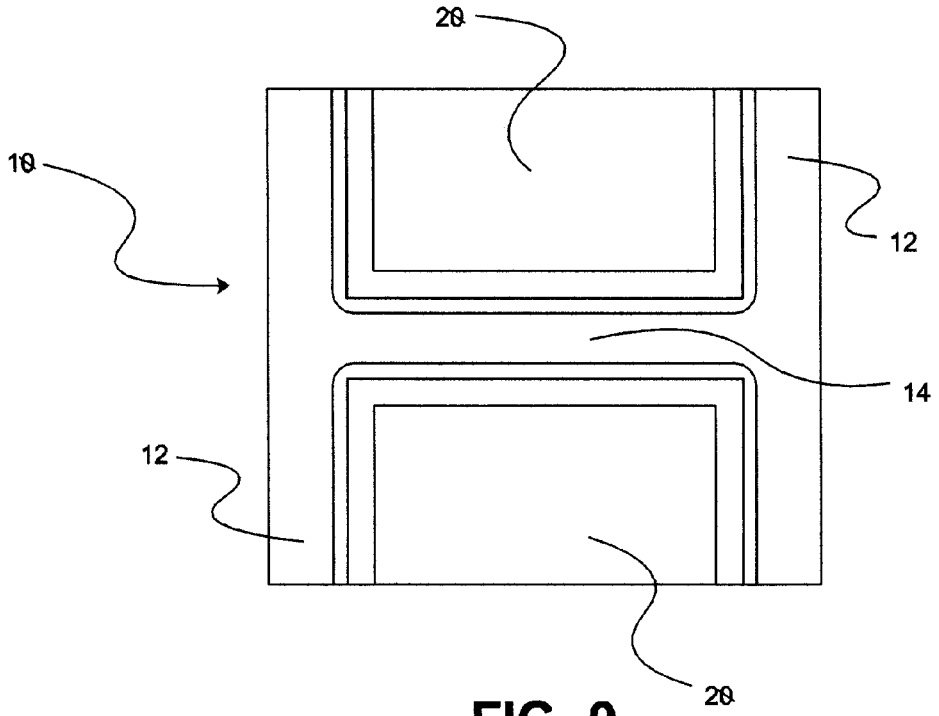
FIG. 9 is a top planar view of multi-pass flux-cored or gasless flux-cored (FCAW) welding set-up for arc welding moment plates (stiffeners) of FIGS. 7 and 8 into an embodiment of improved W-column 10 prior to shipping a plurality of the embodiment of improved W-columns to a building erection site.
Figure 10:
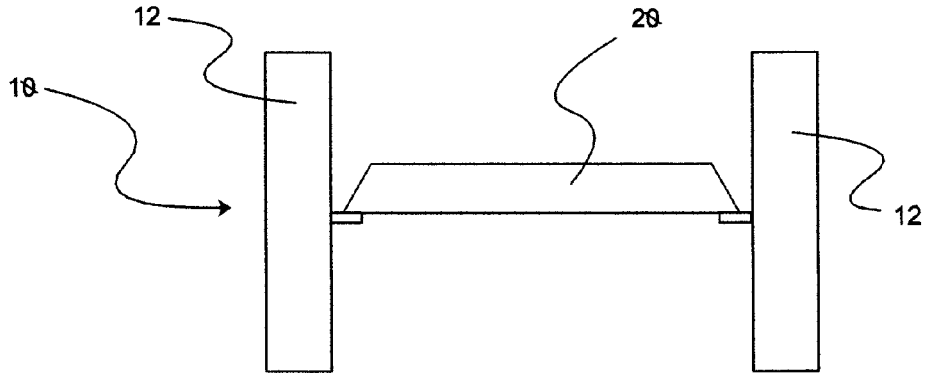
FIG. 10 is an end view of a portion of FIG. 9.

FIGS. 3 and 4 present bolt-on flange connection plates 30 for an embodiment of the new Arcmatic® design for an improved W-column 10, located near the top of the improved W-column 10 of FIGS. 1 and 2. Two of these bolt-on flange connection plates 30 are shop welded to the upper outside surfaces of the two flanges 12 of an embodiment of the improved W-column 10. FIGS. 5 and 6 show similarly sized bolt-on flange connection plates 30 located near the bottom of the embodiment of improved W-column 10. When one embodiment of improved W-column 10 is set on top of another, during the high rise building erection process, these top and bottom bolt-on flange connection plates 30 are designed to be joined together with bolt-on connections 32, e.g., FIG. 15. For an embodiment of the improved W-column 10, these bolt-on connections 32 when bolted in place by suitably sized fasteners between corresponding bolt-on flange connection plates 30 join the corresponding bolt-on flange connection plates 30 together to temporarily hold one embodiment of the improved W-column 10 top to another embodiment of the improved W-column 10 bottom, e.g., FIG. 15, until the final forty-five (45°) degree angle VertaSlag® ESW-NG field welds are completed to permanently join the two paired and vertically aligned W-column 10 flanges 12 and webs 14 together, e.g., FIG. 19.

The top and bottom of an embodiment of the improved W-column 10 flanges 12 are square cut at a forty-five (45°) degree angle to the vertical plane. Accordingly, the bolt-on flange connection plates 30 are staggered vertically (one higher than the other) on the outside surfaces of the embodiment of the improved W-column 10 flanges 12. The bolt-on flange connection plates 30 are arranged so to position the center of the bolt-on connections 32 that join two bolt-on flange connection plates 30 together at the center of the VertaSlag ESW-NG weld cavity 70, e.g., FIG. 16. After the bolt-on connections 32 are bolted to the bolt-on flange connection plates 30, the Arcmatic® patented articulated and/or serrated water-cooled VertaSlag® weld puddle containment devices (articulated copper shoe) are inserted between the bolt-on flange connection plates 30 and the outside surface of the embodiment of the W-column 10 flanges 12. The articulated copper shoes can then be held tightly against the VertaSlag® ESW-NG weld cavity 70 by using a wedge between the bolt-on connection bar 32 and the outside surface of the articulated copper shoe to force the articulated shoe against the two flange 12 surfaces. Thus, the bolt-on connection bar 32 serves at least two purposes. Each bolt-on connection bar 32 holds the embodiment of the upper improved W-column 10 in position until the VertaSlag® ESW-NG weld is completed. And, each bolt-on connection bar 32 holds the articulated copper shoe in position until the VertaSlag® ESW-NG weld is completed.

FIGS. 3-6 also show the bolt-on web connection plate 40 used to bolt an embodiment of the bottom W-column 10 web 14 to the embodiment of the top improved W-column 10 web 14. In this arrangement, when one embodiment of the improved W-column 10 is set on top of another embodiment of the W-column 10, the bolt-on web connection plate 40 temporarily holds the embodiments of the two improved W-column 10 webs 14 together. When the embodiment of the top improved W-column 10 has been set into place on top of the embodiment of the bottom improved W-column 10 web 14, bolts will be quickly inserted into the holes 104, allowing the embodiments of the two improved W-columns 10 to be quickly joined together. Relief grooves 102 cut into both sides of the bottom of the embodiment of the improved W-column 10 web 14 plate (between the bolt-on flange connection plates 30) provide sufficient room for the articulated copper shoes that will be attached to the inside surfaces of an embodiment of the improved W-column 10 flanges 12 after the embodiment of the top improved W-column 10 is placed on top of the embodiment of the bottom improved W-column 10. In this fashion, embodiments of the two W-column 10 webs 14 can be bolted together with the web connection plate 40. An embodiment of the welding shoes (such as the Arcmatic® articulated copper shoes) are attached to the inside surface of the embodiment of the improved W-column 10 flanges 12 from the inside surface of the VertaSlag® weld cavity 70. An embodiment of the outside welding shoes forms the outside surface of the weld cavity. For an embodiment of the improved W-column 10, the bottom surface of the improved W-column 10 flanges 12 are square cut at a forty-five (45°) degree angle to the vertical plane from the bottom surface of the VertaSlag® weld cavity 70, see, e.g., FIG. 15.

For an embodiment of the improved W-column 10, a relief is cut into the top surface of the bottom improved W-column 10 web 14 plate, on either side of the bolt-on web connection plate 40 to provide room for the articulated copper shoe attached to the inside surface of each improved W-column 10 flange 12 plates to cover the inside surface of the forty-five (45°) degree angled VertaSlag® ESW-NG weld cavity 70. A corresponding equal sized relief groove 102 is also cut into the bottom surface of the top improved W-column 10 web 14 plate, on either side of the bolt-on web connection plate 40, FIGS. 2 and 6, to provide room for the articulated copper shoe when embodiments of the two improved W-column 10 columns are fitted together, one embodiment of the improved W-column 10 bottom above the other embodiment of the improved W-column 10 top, e.g., FIGS. 16 and 17. These embodiments of welding shoes are attached to the inside surface of the column flanges form the inside surface of the VertaSlag® ESW-NG weld cavity 70. An embodiment of the outside welding shoes forms the outside surface of the VertaSlag® ESW-NG weld cavity 70.

As has been discussed, an embodiment of the improved W-column 10 top and bottom flanges 12 are square cut at a forty-five (45°) degree angle to the vertical plane, FIGS. 1-6. For an embodiment of the improved W-column 10, the top of the bottom improved W-column 10 web 14 is square cut parallel to the horizontal plane, but the bottom of the top improved W-column 10 web 14 is cut at a forty-five (45°) degree angle that is parallel to the horizontal plane, with a ¼-inch wide land at the bottom of the forty-five (45°) degree angle. When an embodiment of the top improved W-column 10 is set down upon top of an embodiment of the bottom improved W-column 10, the ¼-inch wide land will sit on top of the flat (square cut) surface of the embodiment of the bottom improved W-column 10 web 14. When two vertically aligned embodiments of the improved W-column 10 web 14 surfaces are touching, a ¾-inch gap exists between an embodiments of the upper and lower improved W-column 10 flange 12 surfaces. Spacer blocks 60 are shop tack welded to the top surfaces of embodiments of the two lower improved W-column 10 flanges 12 to provide a surface for embodiments of the upper improved W-column 10 flanges 12 to rest upon until the bolt-on web connection plate 40 and corresponding fastener bolts join embodiments of the upper and lower improved W-column 10 web 14 plates together. After the four bolt-on connections 32 are securely bolted to the corresponding eight bolt-on flange connection plates 30 and the bolt-on web connection plate 40 secures bolt an embodiment of the upper improved W-column 10 web 14 to an embodiment of the lower improved W-column 10 web 14 (to hold the upper column securely in position), the spacer blocks 60 are easily and quickly removed in the field by a cutting torch.

Figure 16:
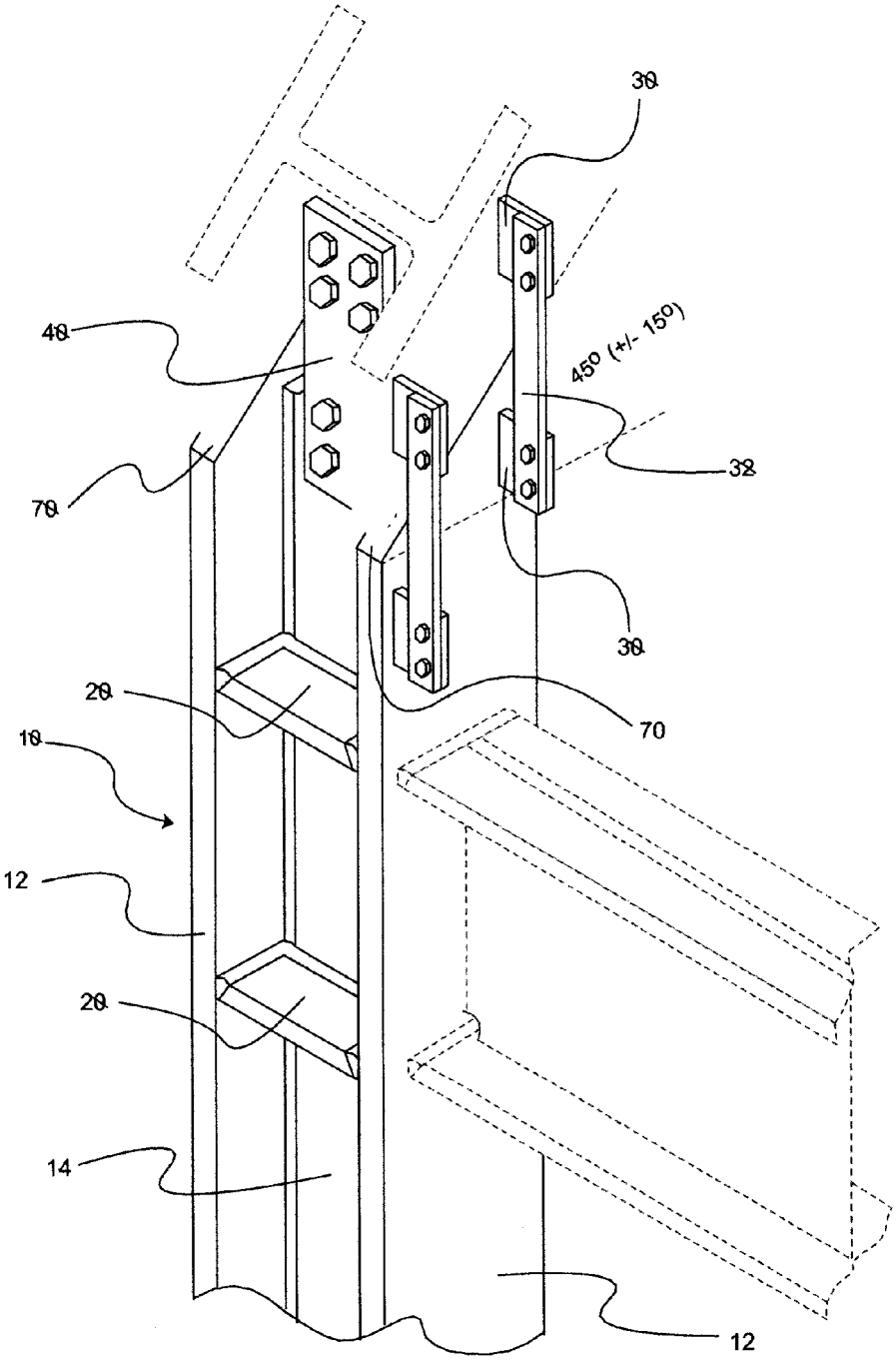
FIG. 16 is the partial perspective view of FIG. 15 with a partial perspective view of FIG. 5 of an embodiment of the improved W-column 10 shown and a bolt-on web connection plate joining embodiments of two separate, improved W-columns 10 in a vertical orientation, one embodiment of the improved W-column 10 above the other, and as also depicted in FIGS. 11 and 12.

FIGS. 13-19 provide details of the building erection process, using an embodiment of the Arcmatic® improved W-column 10 design, particularly how the bottom of an embodiment of the upper improved W-column 10 is in position to be lowered down onto the top of an embodiment of the lower improved W-column 10, see, e.g., FIGS. 15 and 16. This process is repeated, embodiment of the improved W-column 10-after-embodiment of the improved W-column 10, floor by floor, until the building erection process has been completed.

Using this embodiment of the improved W-column 10 design, an embodiment of the improved W-column 10 web connection plates 40 are bolted to an embodiment of the top of the bottom W-column 10 web 14. In this manner, when embodiments of the two improved W-columns 10 are in position (one on top of the other), the top of the web connection plate 40 can be quickly bolted to the embodiment of the top improved W-column 10 web to help hold embodiments of the two improved W-columns 10 (top and bottom) in position to release the connection to the overhead crane used for column placement.

The four bolt-on flange connection plates 30 welded to an embodiment of the top of the bottom improved W-column 10 flanges 12 (two on each flange), and the four bolt-on flange connection plates 30 welded onto an embodiment of the bottom of the top improved W-column 10 flanges 12 (also, two on each flange). After an embodiment of the top improved W-column 10 has been lowered into position, on top of an embodiment of the bottom improved W-column 10, four bolt-on connections 32 are bolted to the matching upper and lower bolt-on flange connection plates 30 to also help hold an embodiment of the top improved W-column 10 in a vertically oriented position so the crane can be released, see, e.g., FIGS. 15 and 16.

The top of an embodiment of the bottom improved W-column 10 web 14 is cut square, parallel to the horizontal plane. For an embodiment of the improved W-column 10, the bottom of the top improved W-column 10 web 14 plate is beveled at a forty-five (45°) degree angle, with a ¼-inch land that is square cut, parallel to the horizontal plane. When the bottom embodiment of the improved W-column 10 web 14 is set on the top of an embodiment of the bottom W-column 10 web 14, the top embodiment of the improved W-column 10 web 14 ¼-inch land sits on top of the top of the flat horizontal surface of an embodiment of the bottom improved W-column 10 web 14. For an embodiment of the improved W-column 10, the forty-five (45°) degree angled weld groove is welded using known multi-pass FCAW welding process to join the embodiments of the improved W-column 10 webs 14 together between the embodiments of the improved W-columns 10.

In the center of this side view the single bevel used to weld the two thinner web plates together is illustrated, FIGS. 12-15. Thinner web plates are generally considered web plates under 1½-inches thick. Thinner plates generally use a single bevel to join the upper and lower web plates together. Web plate thicker than 1½-inches are generally joined together with a "double-bevel" weld joint, with a ¼-inch land in the center of the two bevels.

Figure 11:
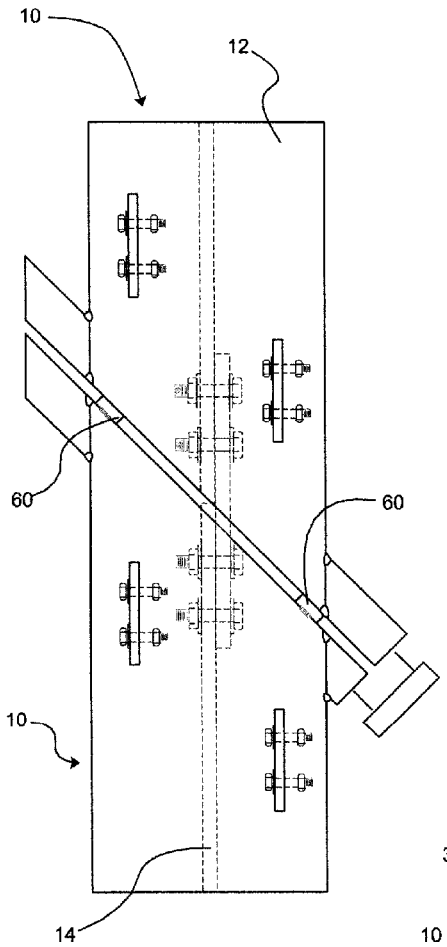
FIG. 11 is detail side elevation view of embodiments of two separate, but identical, improved W-columns 10 of FIG. 1 placed together with the detail side elevation view of the embodiment of improved W-column 10 of FIG. 1 taken at "3-3" of an embodiment of bottom, improved W-column 10 joining the detail side elevation view of the embodiment of improved W-column 10 of FIG. 1 taken at "5-5" of an embodiment of improved top W-column 10.
Figure 12:
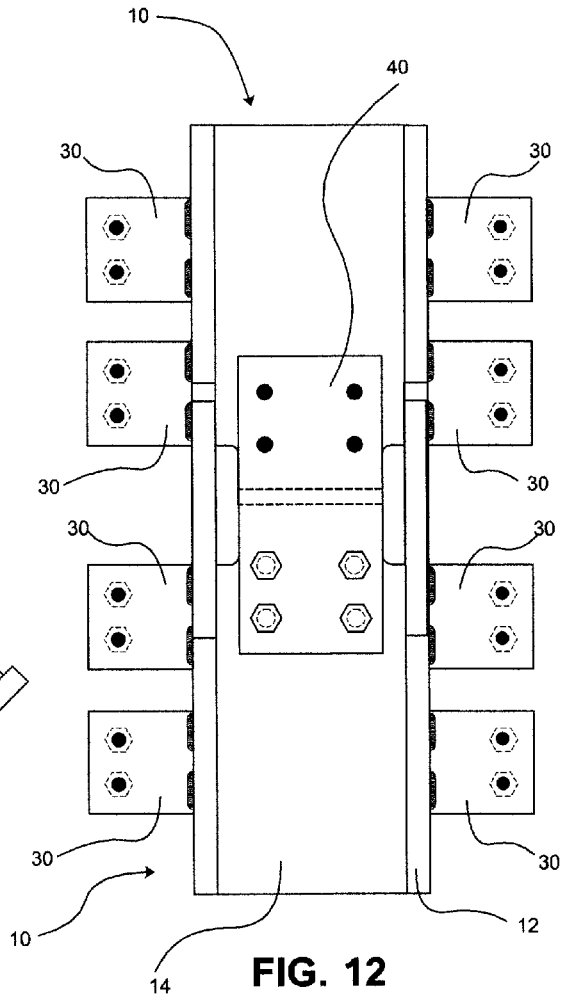
FIG. 12 is detail front elevation view of FIG. 11.
Figure 13:
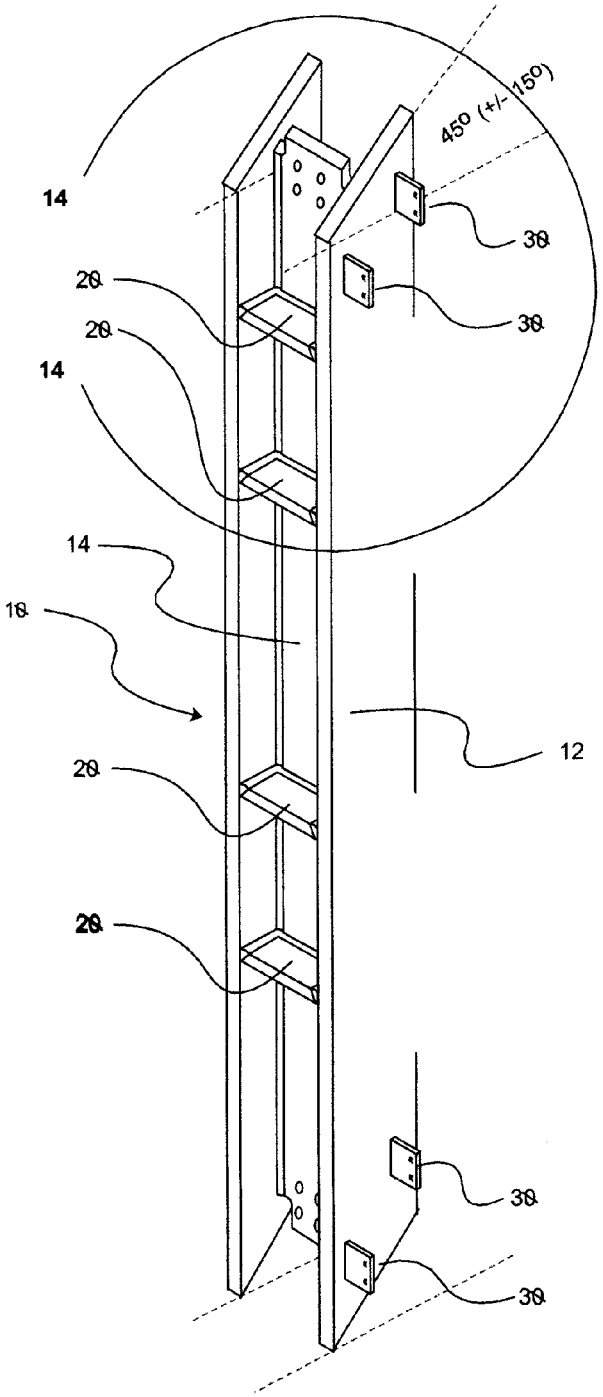
FIG. 13 is a top right perspective view of FIG. 2.
Figure 14:
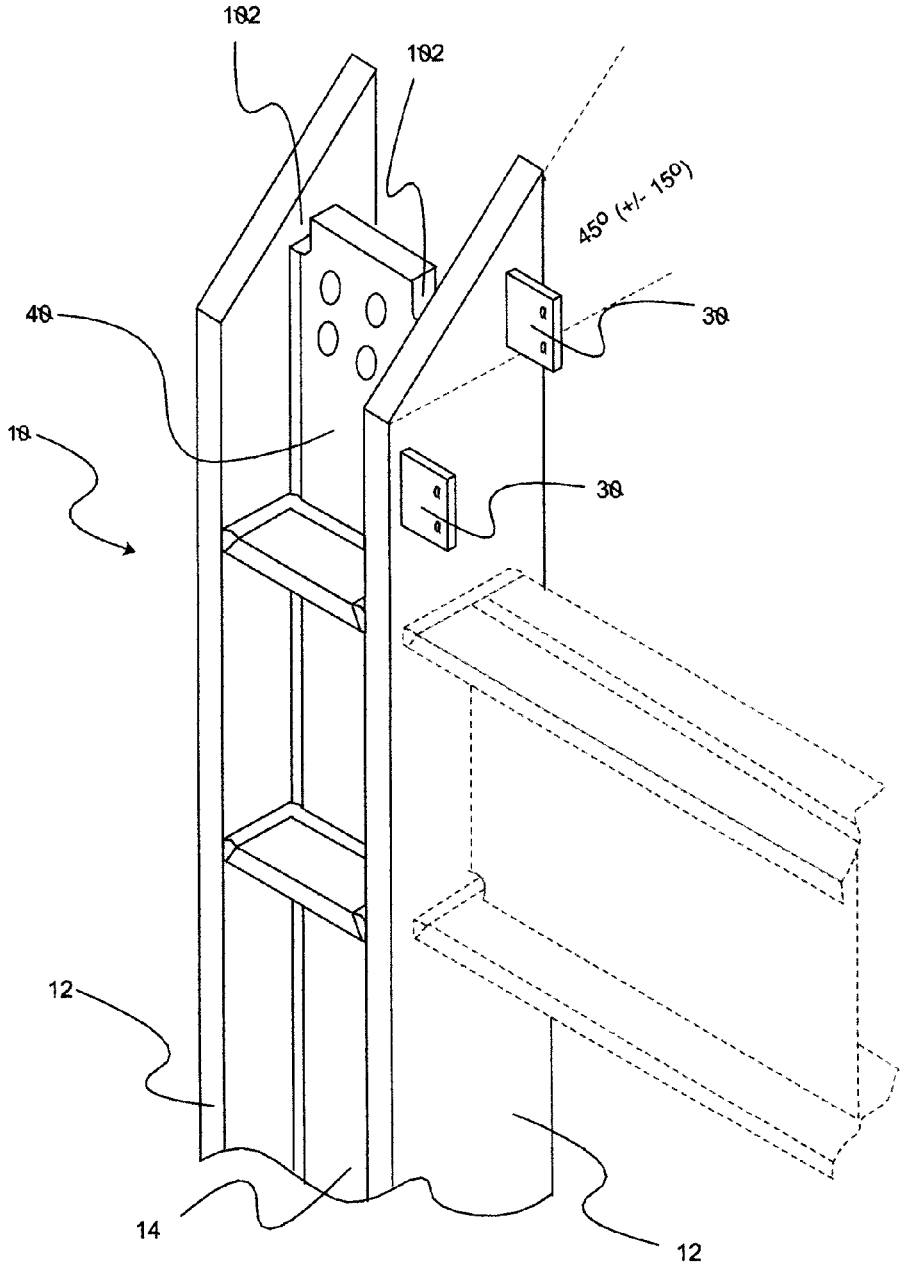
FIG. 14 is a detailed perspective view of FIG. 13 taken at "14-14" [also the partial detailed perspective view of an embodiment of the improved W-column 10 of FIG. 4].

The side view, FIG. 11, shows the ¾-inch (+/−⅛-in) wide gap between the embodiments of the upper and lower improved W-column 10 flanges 14 that forms the VertaSlag® (ESW-NG) weld cavity 70. For an embodiment of the improved W-column 10, it should be noted that two spacer blocks 60 are placed on the top of the embodiment of the lower improved W-column 10 flanges 12; one near the bottom of the 45-degree bevel, and one near the top of the 45-degree bevel. These spacer blocks 60 are temporarily tack welded onto the top surface of the lower improved W-column 10 flanges 12. Thus, when an embodiment of the upper improved W-column 10 web 14 comes to rest on top of an embodiment of the lower improved W-column 10 web 14, the embodiment of the upper improved W-column 10 flanges 12 will rest solidly on top of the spacer blocks 60 to stabilize an embodiment of the upper improved W-column 10 until the bolt-on flange connection plates 30 have been bolted together with the bolt-on connections 32, and the bolt-on web plate 40 has bolted the embodiment of the upper improved W-column 10 web 14 to an embodiment of the lower improved W-column 10 web 14 to stabilize an embodiment of the upper improved W-column 10 until embodiments of the upper and lower improved W-column 10 flanges 12 are ready to be welded together.

After embodiments of the improved W-column 10 web and the flanges have been securely bolted together, the spacer blocks 60 are removed and embodiments of the welding shoes are slid under the bolt-on connections and embodiments of the welding shoes are then held securely in place simple clamping mechanism that holds the inside and outside copper shoes firmly against embodiments of the upper and lower improved W-column 10 flanges 12 to form the upper and lower surfaces of the VertaSlag® weld cavity 70.

Once the crane is released from an embodiment of the top improved W-column 10, the embodiments of the top and bottom W-column 10 flanges 12 meet at a forty-five (45°) degree angle to the vertical plane, with a ¾" weld cavity 70 between embodiments of the top and bottom W-column 10 flanges 12, see, e.g., FIGS. 16-18. This ¾" weld cavity 70 provides the interface for the VertaSlag® ESW-NG weld 72 to permanently join two embodiments of the improved W-column 10 flanges 12 together in a vertical orientation, one to the other, see, e.g., FIG. 19.

The angle between embodiments of the top and bottom W-column 10 flanges 12 can vary ±fifteen (15°) degrees from the preferred forty-five (45°) degree angle to the vertical plane for embodiments of the improved W-column 10. In such circumstances, it will be understood by persons having ordinary skill in the art that corresponding top and bottom angles for these embodiments of the improved W-column 10 will necessarily vary ±fifteen (15°) degrees the forty-five (45°) degree angle to the vertical plane, but when added together the differing top W-column 10 flange 12 and bottom W-column 10 flange 12 angles will equal ninety (90°) degrees to maintain the orthogonal orientation of embodiments of the erected W-columns to the vertical plane, as would be provided by an embodiment of improved W-column 10 having a top W-column 10 flange 12 and a bottom W-column 10 flange 12 that meet at a forty-five (45°) degree angles to the vertical plane.

Figure 19:
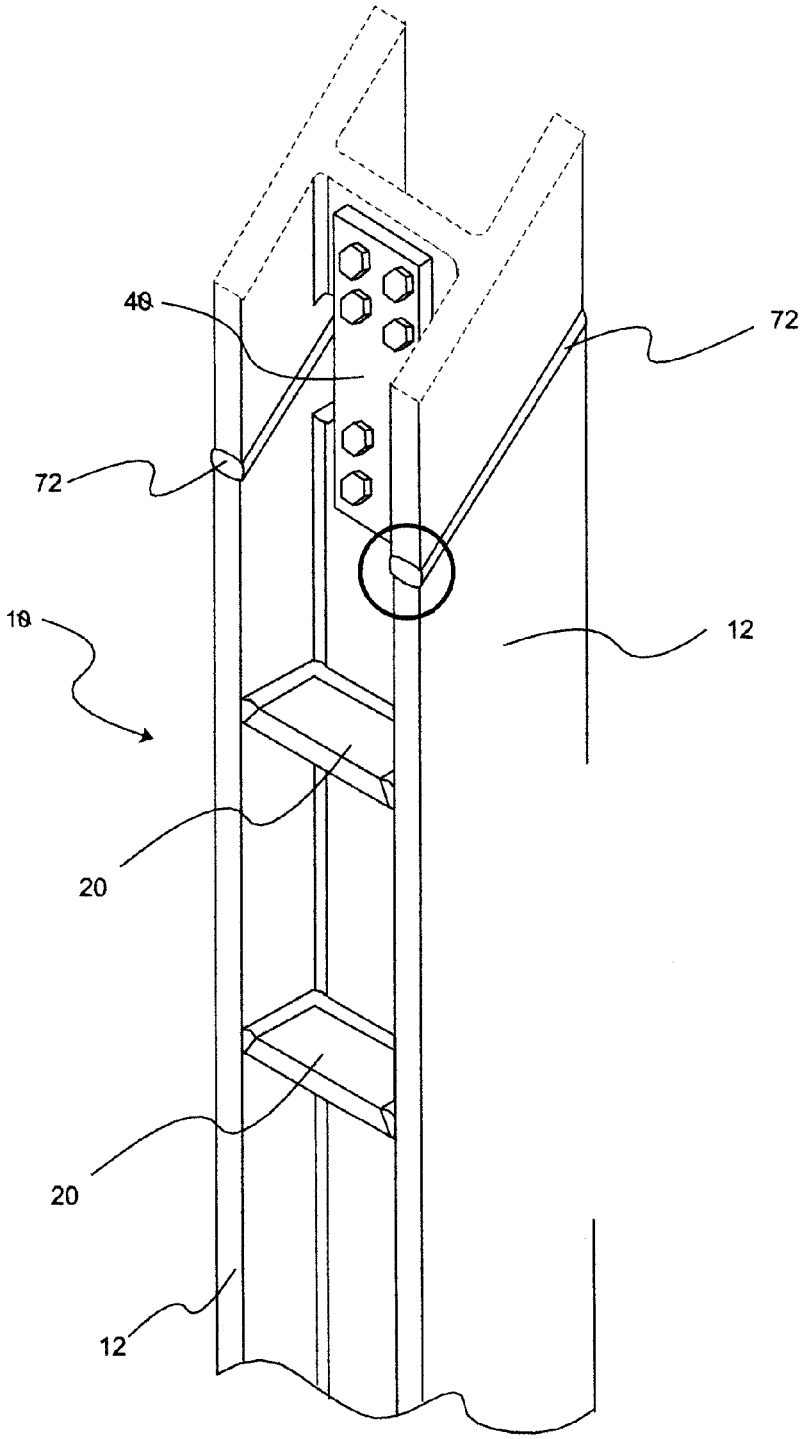
FIG. 19 is a top right partial perspective view of completed VertaSlag® (ESW-NG) welds 72 between embodiments of two vertically aligned W-columns 10 of FIG. 11.

An embodiment of the improved W-column 10 is used to erect steel framed high rise building according to an embodiment methodology depicted generally as follows:

a) providing at least one embodiment of the W-column as depicted in FIGS. 1-8;
b) providing at least one crane;
c) connecting the crane to at least one W-column top end;
d) positioning a bottom end of the upper W-column connected to the crane above a top end of a prior, vertically erected lower W-column so that the bottom end and top end acute angled W-column flanges are parallel, and so that a W-column web bolt-on connection plate is oriented on the same W-column web surfaces of the W-column connected to the crane and the vertically erected W-column, FIGS. 11 and 16;
e) lowering the W-column connected to the crane down to rest on spacer blocks tack welded to the vertically erected W-column top end flanges, FIGS. 11 and 16;
f) bolting the connection plate of the vertically erected lower W-column to the web of the upper W-column connected to the crane, FIG. 16;
g) bolting the four bolt-on connections to the upper and lower W-column flange tabs, FIGS. 11 and 16;
h) releasing the W-column from the crane;
i) removing the spacer blocks from between the upper and lower W-column flanges;
j) attaching articulated welding shoes and associated run-off tabs to each weld gap between the upper and lower W-column flanges, FIGS. 17 and 18;
k) positioning an automated, vertical Electroslag narrow-gap welding system and associated peripheral assemblies into each weld gap;
l) welding the upper W-column flanges to the vertically erected lower W-column flanges;
m) removing the automated, vertical Electroslag narrow-gap welding system and associated peripheral assemblies from each weld gap;
n) removing the articulated welding shoes and associated run-off tabs from the welded upper and lower W-columns, FIG. 19; and
o) repeating steps a)-n) until all vertical W-columns have been welded into position in the on-site steel framed high rise building.

I claim:

1. An improved W-column, comprising in combination:

a) a longitudinal length of two parallel W-column flanges, each W-column flange comprising a flange top end cut at an acute angle and a flange bottom end cut at an acute angle, a flange outer surface comprising at least one bolt-on flange tab comprising at least one aperture, and a flange inner surface, each flange top end comprising at least two spacer blocks tack welded to the acute angle cut, flange top end;
b) a longitudinal length of W-column web connecting the two parallel W-column flanges and comprising a web front surface, a web rear surface, a web top end further comprising at least one relief groove and a plurality of apertures through the web front surface and the web rear surface, a web bottom end further comprising at least one relief groove and at least one beveled side, and a plurality of apertures through the web front surface and the web rear surface;
c) at least one moment connection between W-column cut flange ends, the at least one moment connection comprising a pair of front moment plates, each of the front moment plates corresponding to the web front surface and each flange inner surface corresponding to the web front surface at a predetermined position relative to the parallel W-column flanges and W-column web, and a pair of rear moment plates, each of the rear moment plates corresponding to the web rear surface and each flange inner surface corresponding to the web rear surface at the predetermined position relative to the parallel W-column flanges and W-column web;
d) a web assembly affixed to the W-column web top end to align and connect the W-column web top end to a second W-column web bottom end when the second W-column is vertically positioned above the W-column; and
e) a flange assembly affixed to the W-column flange outer surface at the W-column flange top and bottom ends to connect the W-column flange top ends to the second W-column flange bottom ends and align the respective flange top and bottom ends to provide dual, parallel equal sized weld cavities between the first W-column flange top ends and the second W-column flange bottom ends, comprising at least one bolt-on connection comprising at least one aperture and sized to be received by and connected to the at least one bolt-on flange tab with at least one fastener sized to correspond to the at least one bolt-on connection aperture and the at least one bolt-on flange tab aperture.

2. The improved W-column of claim 1, wherein the longitudinal length of the W-column web connecting the two parallel W-column flanges is at least thirty (30') feet.

3. The improved W-column of claim 1, wherein the W-column flange top end acute angle and the W-column flange bottom end acute angle each equal forty-five (45°) degrees.

4. The improved W-column of claim 1, wherein the W-column flange top end acute angle is forty-five (45°) degrees—plus or minus fifteen (±15°) degrees, and the W-column flange bottom end acute angle is forty-five (45°) degrees—plus or minus fifteen (±15°) degrees, and the sum of the W-column flange top end acute angle and the W-column flange bottom end acute angle equals ninety (90°) degrees.

5. The improved W-column of claim 2, wherein the at least one moment connection pair of front moment plates are welded to the web front surface and each flange inner surface corresponding to the web front surface at a predetermined position relative to the parallel W-column flanges and W-column web, and the at least one moment connection pair of rear moment plates are welded to the web rear surface and each flange inner surface corresponding to the web rear surface at the predetermined position relative to the parallel W-column flanges and W-column web with each at least one moment connection pair of front moment plates and rear moment plates at equal distances along the improved W-column from the W-column web top end.

6. The improved W-column of claim 5, further comprising three moment connection pairs of front moment plates and rear moment plates positioned such that the longitudinal length of the W-column web between each set of moment connection pairs of front moment+plates and rear moment plates is twelve (12') feet.

7. The improved W-column of claim 1, wherein the web assembly affixed to the W-column web top end to align and connect the W-column web top end to a second W-column web bottom end when the second W-column is vertically positioned above the W-column comprises at least one bolt-on web connection plate comprising a plurality of apertures and sized to be received on each W-column web top end and W-column web bottom end such that the bolt-on web connection plate apertures are aligned with the corresponding W-column web top end apertures and W-column web bottom end apertures with a plurality of fasteners to correspond to the plurality of bolt-on web connection plate apertures, the plurality of W-column web top end apertures, and the plurality of W-column web bottom end apertures.

8. A method of erecting a steel framed high rise building on-site using an improved W-column, the method comprising the steps:

a) providing at least one W-column according to claim 3;
b) providing at least one crane;
c) connecting the crane to at least one W-column top end;
d) positioning a bottom end of the at least W-column connected to the crane above a top end of a prior, vertically erected lower W-column so that the bottom end and top end acute angled W-column flanges are parallel, and so that a W-column web bolt-on connection plate is oriented on the same W-column web surfaces of the W-column connected to the crane and the vertically erected W-column;
e) lowering the W-column connected to the crane down to rest on the spacer blocks tack welded to the vertically erected W-column top end flanges;
f) bolting the connection plate of the vertically erected lower W-column web to the web of the upper W-column connected to the crane;
g) bolting the four bolt-on connections to the upper and lower W-column flange tabs;
h) welding the web of the vertically erected lower W-column to the web of the upper W-column;
i) removing the web connection plate from the vertically erected lower W-column web and the upper W-column web, if not already removed in step h);
j) releasing the upper W-column from the crane;
k) removing the spacer blocks from between the upper and lower W-column flanges;
l) attaching articulated welding shoes and associated run-off tabs to each weld gap between the upper and lower W-column flanges;
m) positioning an automated, vertical Electroslag narrow-gap welding system and associated peripheral assemblies into each weld gap;
n) welding the upper W-column flanges to the vertically erected lower W-column flanges;
o) removing the automated, vertical Electroslag narrow-gap welding system and associated peripheral assemblies from each weld gap;
p) removing the articulated welding shoes and associated run-off tabs from the welded upper and lower W-columns;
q) repeating steps a)-p) until all vertical W-columns have been welded into position in the on-site steel framed high rise building.

9. The method of claim 8, wherein step h. further comprises the steps:

h.1) for larger columns, welding a double beveled upper W-column web plate bottom to the lower W-column web plate top on the first beveled side opposite the connection plate with multi-pass flux cored welding wire, and then removing the connection plate, back-gouging the second beveled side, and welding the second beveled side of the upper W-column web plate bottom to the lower W-column web plate top with multi-pass flux cored welding wire; or
h.2) for smaller columns, welding a single beveled upper W-column web plate bottom to the lower W-column web plate top on the first beveled side opposite the connection plate with multi-pass flux cored welding wire.

10. An improved W-column, comprising in combination:

a) a longitudinal length of two parallel W-column flanges, each W-column flange comprising a flange top end cut at an acute angle and a flange bottom end cut at an acute angle, a flange outer surface comprising at least one bolt-on flange tab comprising at least one aperture, and a flange inner surface, each flange top end comprising at least two spacer blocks tack welded to the acute angle cut, flange top end;
b) a longitudinal length of W-column web connecting the two parallel W-column flanges and comprising a web front surface, a web rear surface, a web top end further comprising at least one relief groove and a plurality of apertures through the web front surface and the web rear surface, a web bottom end further comprising at least one relief groove and at least one beveled side, and a plurality of apertures through the web front surface and the web rear surface;
c) at least one moment connection between W-column cut flange ends, the at least one moment connection comprising a pair of front moment plates, each of the front moment plates corresponding to the web front surface and each flange inner surface corresponding to the web front surface at a predetermined position relative to the parallel W-column flanges and W-column web, and a pair of rear moment plates, each of the rear moment plates corresponding to the web rear surface and each flange inner surface corresponding to the web rear surface at the predetermined position relative to the parallel W-column flanges and W-column web;

d) at least one bolt-on web connection plate comprising a plurality of apertures and sized to be received on each W-column web top end and W-column web bottom end such that the bolt-on web connection plate apertures are aligned with the corresponding W-column web top end apertures and W-column web bottom end apertures with a plurality of fasteners to correspond to the plurality of bolt-on web connection plate apertures, the plurality of W-column web top end apertures, and the plurality of W-column web bottom end apertures; and e) at least one bolt-on connection comprising at least one aperture and sized to be received by and connected to the at least one bolt-on flange tab with at least one fastener sized to correspond to the at least one bolt-on connection aperture and the at least one bolt-one flange tab aperture, each bolt-on connection affixed to the W-column flange outer surface at the W-column flange top and bottom ends to connect the W-column flange top ends to a second W-column flange bottom ends and align the respective flange top and bottom ends to provide dual, parallel equal sized weld cavities between the W-column flange top ends and the second W-column flange bottom ends.

11. The improved W-column of claim 10, wherein the longitudinal length of the W-column web connecting the two parallel W-column flanges is at least thirty (30') feet.

12. The improved W-column of claim 10, wherein the W-column flange top end acute angle and the W-column flange bottom end acute angle each equal forty-five (45°) degrees.

13. The improved W-column of claim 10, wherein the W-column flange top end acute angle is forty-five (45°) degrees—plus or minus fifteen (±15°) degrees, and the W-column flange bottom end acute angle is forty-five (45°) degrees—plus or minus fifteen (±15°) degrees, and the sum of the W-column flange top end acute angle and the W-column flange bottom end acute angle equals ninety (90°) degrees.

14. The improved W-column of claim 11, wherein the at least one moment connection pair of front moment plates are welded to the web front surface and each flange inner surface corresponding to the web front surface at a predetermined position relative to the parallel W-column flanges and W-column web, and the at least one moment connection pair of rear moment plates are welded to the web rear surface and each flange inner surface corresponding to the web rear surface at the predetermined position relative to the parallel W-column flanges and W-column web with each at least one moment connection pair of front moment plates and rear moment plates at equal distances along the improved W-column from the W-column web top end.

15. The improved W-column of claim 14, further comprising three moment connection pairs of front moment plates and rear moment plates positioned such that the longitudinal length of the W-column web between each set of moment connection pairs of front moment plates and rear moment plates is at least twelve (12') feet.

16. A method of erecting a steel framed high rise building on-site using an improved W-column, the method comprising the steps:

a) providing at least one W-column according to claim 10;

b) providing at least one crane;

c) connecting the crane to at least one W-column top end;

d) positioning a bottom end of the at least W-column connected to the crane above a top end of a prior, vertically erected lower W-column so that the bottom end and top end acute angled W-column flanges are parallel, and so that a W-column web bolt-on connection plate is oriented on the same W-column web surfaces of the W-column connected to the crane and the vertically erected W-column;

e) lowering the W-column connected to the crane down to rest on the spacer blocks tack welded to the vertically erected W-column top end flanges;

f) bolting the web connection plate of the vertically erected lower W-column to the web of the upper W-column connected to the crane;

g) bolting the four bolt-on connections to the upper and lower W-column flange tabs;

h) welding the web of the vertically erected lower W-column to the web of the upper W-column;

i) removing the web connection plate from the vertically erected lower W-column web and the upper W-column web, if not already removed in step h);

j) releasing the upper W-column from the crane;

k) removing the spacer blocks from between the upper and lower W-column flanges;

l) attaching articulated welding shoes and associated run-off tabs to each weld gap between the upper and lower W-column flanges;

m) positioning an automated, vertical Electroslag narrow-gap welding system and associated peripheral assemblies into each weld gap;

n) welding the upper W-column flanges to the vertically erected lower W-column flanges;

o) removing the automated, vertical Electroslag narrow-gap welding system and associated peripheral assemblies from each weld gap;

p) removing the articulated welding shoes and associated run-off tabs from the welded upper and lower W-columns;

q) repeating steps a)-p) until all vertical W-columns have been welded into position in the on-site steel framed high rise building.

17. The method of claim 16, wherein step h) further comprises the steps:

h.1) for larger columns, welding a double beveled upper W-column web plate bottom to the lower W-column web plate top on the first beveled side opposite the connection plate with multi-pass flux cored welding wire, and then removing the connection plate, back-gouging the second beveled side, and welding the second beveled side of the upper W-column web plate bottom to the lower W-column web plate top with multi-pass flux cored welding wire; or h.2) for smaller columns, welding a single beveled upper W-column web plate bottom to the lower W-column web plate top on the first beveled side opposite the connection plate with multi-pass flux cored welding wire.

18. The method of claim 16, wherein the W-column flange top end acute angle and the W-column flange bottom end acute angle each equal forty-five (45°) degrees.

19. The method of claim 16, wherein the W-column flange top end acute angle is forty-five (45°) degrees—plus or minus fifteen (±15°) degrees, and the W-column flange bottom end acute angle is forty-five (45°) degrees—plus or minus fifteen (±15°) degrees, and the sum of the W-column flange top end acute angle and the W-column flange bottom end acute angle equals ninety (90°) degrees.

20. The method of claim 16, wherein each W-column comprises at least one moment connection between W-column cut flange ends, the at least one moment connection comprising a pair of front moment plates, each of the front moment plates corresponding to the web front surface and each flange inner surface corresponding to the web front surface at a predetermined position relative to the parallel W-column flanges and W-column web, and a pair of rear moment plates, each of the rear moment plates corresponding to the web rear surface and each flange inner surface corresponding to the web rear surface at the predetermined position relative to the parallel W-column flanges and W-column web.

21. The method of claim 20, wherein the longitudinal length of the W-column web connecting the two parallel W-column flanges is at least thirty (30') feet.

22. The method of claim 21, further comprising three moment connection pairs of front moment plates and rear moment plates positioned such that the longitudinal length of the W-column web between each set of moment connection pairs of front moment plates and rear moment plates is at least twelve (12') feet.

* * * * *